US009156602B1

(12) United States Patent
Hanson et al.

(10) Patent No.: US 9,156,602 B1
(45) Date of Patent: Oct. 13, 2015

(54) ACTUATORS FOR DISPENSERS FOR TEXTURE MATERIAL

(71) Applicant: Homax Products, Inc., Bellingham, WA (US)

(72) Inventors: Randal W. Hanson, Bellingham, WA (US); Ross Clawson, Bellingham, WA (US)

(73) Assignee: Homax Products, Inc., Bellingham, WA (US)

( * ) Notice: Subject to any disclaimer, the term of this patent is extended or adjusted under 35 U.S.C. 154(b) by 132 days.

(21) Appl. No.: 13/897,178

(22) Filed: May 17, 2013

Related U.S. Application Data

(60) Provisional application No. 61/648,519, filed on May 17, 2012.

(51) Int. Cl.

| | |
|---|---|
| ***B05B 1/30*** | (2006.01) |
| ***B05B 1/32*** | (2006.01) |
| ***B65D 83/28*** | (2006.01) |
| ***B65D 83/44*** | (2006.01) |

(52) U.S. Cl.
CPC ..... *B65D 83/28* (2013.01); *B05B 1/3026* (2013.01); *B05B 1/30* (2013.01); *B05B 1/326* (2013.01)

(58) Field of Classification Search
CPC ..... B05B 1/12; B05B 1/30; B05B 1/3026; B05B 1/3033; B05B 1/32; B05B 1/326; B65D 83/28; B65D 83/30; B65D 83/303; B65D 83/44; B65D 83/52; B65D 83/525
See application file for complete search history.

(56) References Cited

U.S. PATENT DOCUMENTS

| | | | |
|---|---|---|---|
| 208,330 | A | 9/1878 | Palmer |
| 351,968 | A | 11/1886 | Derrick |

(Continued)

FOREIGN PATENT DOCUMENTS

| | | |
|---|---|---|
| CA | 770467 | 10/1967 |
| CA | 976125 | 10/1975 |

(Continued)

OTHER PUBLICATIONS

ATSM, "Standard Test Method for Conducting Cyclic Potentiodynamic Polarization Measurements for Localized Corrosion Susceptibility of Iron-Nickel, or Cobalt-Based Alloys," 1993, 5 pages.

(Continued)

*Primary Examiner* — Darren W Gorman
(74) *Attorney, Agent, or Firm* — Michael R. Schacht

(57) ABSTRACT

Stored material is dispensed in a spray by defining a chamber and arranging the stored material and pressurized material within the chamber. A conduit passageway is arranged such that a conduit inlet is arranged within the chamber and a conduit outlet is arranged outside of the chamber. An adjustment system comprising an actuator member and first and second adjustment members is provided. The actuator member is arranged to define at least a portion of the conduit passageway. The first and second adjustment members are supported on the actuator member such that the conduit outlet is defined by a first surface of the first adjustment member and a second surface of the second adjustment member. Moving the first and second adjustment members relative to each other alters a cross-sectional area of the conduit outlet and thereby varies a flow of stored material along the conduit passageway at the conduit outlet.

12 Claims, 8 Drawing Sheets

(56) References Cited

U.S. PATENT DOCUMENTS

| | | | |
|---|---|---|---|
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,486,156 | A | 3/1924 | Needham |
| 2,127,188 | A | 8/1938 | Schellin et al. |
| 2,149,930 | A | 3/1939 | Plastaras |
| D134,562 | S | 12/1942 | Murphy |
| 2,307,014 | A | 1/1943 | Becker et al. |
| 2,320,964 | A | 6/1943 | Yates |
| 2,353,318 | A | 7/1944 | Scheller |
| 2,388,093 | A | 10/1945 | Smith |
| 2,530,808 | A | 11/1950 | Cerasi |
| 2,565,954 | A | 8/1951 | Dey |
| 2,612,293 | A | 9/1952 | Michel |
| 2,686,652 | A | 8/1954 | Carlson et al. |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,831,618 | A | 4/1958 | Soffer et al. |
| 2,839,225 | A | 6/1958 | Soffer et al. |
| 2,908,446 | A | 10/1959 | Strouse |
| 2,932,434 | A | 4/1960 | Abplanalp |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 3,083,872 | A | 4/1963 | Meshberg |
| 3,107,059 | A | 10/1963 | Frechette |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,216,628 | A | 11/1965 | Fergusson |
| 3,246,850 | A | 4/1966 | Bourke |
| 3,258,208 | A | 6/1966 | Greenebaum, II |
| 3,284,007 | A | 11/1966 | Clapp |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford |
| 3,405,845 | A | 10/1968 | Cook et al. |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,513,886 | A | 5/1970 | Easter et al. |
| 3,514,042 | A | 5/1970 | Freed |
| 3,544,258 | A | 12/1970 | Presant et al. |
| 3,548,564 | A | 12/1970 | Bruce et al. |
| 3,550,861 | A | 12/1970 | Teson |
| 3,575,319 | A | 4/1971 | Safianoff |
| 3,592,359 | A | 7/1971 | Marraffino |
| 3,596,835 | A | 8/1971 | Smith et al. |
| 3,608,822 | A | 9/1971 | Berthoud |
| 3,613,954 | A | 10/1971 | Bayne |
| 3,648,932 | A | 3/1972 | Ewald et al. |
| 3,653,558 | A | 4/1972 | Shay |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,705,669 | A | 12/1972 | Cox et al. |
| 3,711,030 | A | 1/1973 | Jones |
| 3,764,067 | A | 10/1973 | Coffey et al. |
| 3,770,166 | A | 11/1973 | Marand |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,891,128 | A | 6/1975 | Smrt |
| 3,912,132 | A | 10/1975 | Stevens |
| 3,913,803 | A | 10/1975 | Laauwe |
| 3,913,804 | A | 10/1975 | Laauwe |
| 3,913,842 | A | 10/1975 | Singer |
| 3,932,973 | A | 1/1976 | Moore |
| 3,936,002 | A | 2/1976 | Geberth, Jr. |
| 3,938,708 | A | 2/1976 | Burger |
| 3,975,554 | A | 8/1976 | Kummins et al. |
| 3,982,698 | A | 9/1976 | Anderson |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,673 | A | 7/1977 | Murphy et al. |
| 4,045,860 | A | 9/1977 | Winckler |
| 4,089,443 | A | 5/1978 | Zrinyi |
| 4,096,974 | A | 6/1978 | Haber et al. |
| 4,117,951 | A | 10/1978 | Winckler |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,164,492 | A | 8/1979 | Cooper |
| RE30,093 | E | 9/1979 | Burger |
| 4,171,757 | A | 10/1979 | Diamond |
| 4,173,558 | A | 11/1979 | Beck |
| 4,185,758 | A | 1/1980 | Giggard |
| 4,187,959 | A | 2/1980 | Pelton |
| 4,187,985 | A | 2/1980 | Goth |
| 4,198,365 | A | 4/1980 | Pelton |
| 4,202,470 | A | 5/1980 | Fujii |
| 4,238,264 | A | 12/1980 | Pelton |
| 4,240,940 | A | 12/1980 | Vasishth et al. |
| 4,258,141 | A | 3/1981 | Jarre et al. |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |
| 4,346,743 | A | 8/1982 | Miller |
| 4,354,638 | A | 10/1982 | Weinstein |
| 4,358,388 | A | 11/1982 | Daniel et al. |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,438,221 | A | 3/1984 | Fracalossi et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |

(56) References Cited

U.S. PATENT DOCUMENTS 4,546,905 A 10/1985 Nandagiri et al.
4,595,127 A 6/1986 Stoody
4,609,608 A 9/1986 Solc
4,641,765 A 2/1987 Diamond
4,683,246 A 7/1987 Davis et al.
4,702,400 A 10/1987 Corbett
4,728,007 A 3/1988 Samuelson et al.
4,744,495 A 5/1988 Warby
4,761,312 A 8/1988 Koshi et al.
4,792,062 A 12/1988 Goncalves
4,793,162 A 12/1988 Emmons
4,804,144 A 2/1989 Denman
4,815,414 A 3/1989 Duffy et al.
4,819,838 A 4/1989 Hart, Jr.
4,830,224 A 5/1989 Brison
4,839,393 A 6/1989 Buchanan et al.
4,854,482 A 8/1989 Bergner
4,870,805 A 10/1989 Morane
4,878,599 A 11/1989 Greenway
4,887,651 A 12/1989 Santiago
4,893,730 A 1/1990 Bolduc
4,896,832 A 1/1990 Howlett
D307,649 S 5/1990 Henry
4,940,171 A 7/1990 Gilroy
4,949,871 A 8/1990 Flanner
4,953,759 A 9/1990 Schmidt
4,954,544 A 9/1990 Chandaria
4,955,545 A 9/1990 Stern et al.
4,961,537 A 10/1990 Stern
4,969,577 A 11/1990 Werding
4,969,579 A 11/1990 Behar
4,988,017 A 1/1991 Schrader et al.
4,991,750 A 2/1991 Moral
5,007,556 A 4/1991 Lover
5,009,390 A 4/1991 McAuliffe, Jr. et al.
5,037,011 A 8/1991 Woods
5,038,964 A 8/1991 Bouix
5,052,585 A 10/1991 Bolduc
5,059,187 A 10/1991 Sperry et al.
5,065,900 A 11/1991 Scheindel
5,069,390 A 12/1991 Stern et al.
5,083,685 A 1/1992 Amemiya et al.
5,100,055 A 3/1992 Rokitenetz et al.
5,115,944 A 5/1992 Nikolich
5,126,086 A 6/1992 Stoffel
5,169,037 A 12/1992 Davies et al.
5,182,316 A 1/1993 DeVoe et al.
5,188,263 A 2/1993 Woods
5,188,295 A 2/1993 Stern et al.
5,211,317 A 5/1993 Diamond et al.
5,219,609 A 6/1993 Owens
5,250,599 A 10/1993 Swartz
5,277,336 A 1/1994 Youel
5,297,704 A 3/1994 Stollmeyer
5,307,964 A 5/1994 Toth
5,310,095 A 5/1994 Stern et al.
5,312,888 A 5/1994 Nafziger et al.
5,314,097 A 5/1994 Smrt et al.
5,323,963 A 6/1994 Ballu
5,341,970 A 8/1994 Woods
5,342,597 A 8/1994 Tunison, III
5,368,207 A 11/1994 Cruysberghs
5,374,434 A 12/1994 Clapp et al.
5,405,051 A 4/1995 Miskell
5,409,148 A 4/1995 Stern et al.
5,417,357 A 5/1995 Yquel
D358,989 S 6/1995 Woods
5,421,519 A 6/1995 Woods
5,425,824 A 6/1995 Marwick
5,450,983 A 9/1995 Stern et al.
5,467,902 A 11/1995 Yquel
5,476,879 A 12/1995 Woods et al.
5,489,048 A 2/1996 Stern et al.
5,498,282 A 3/1996 Miller et al.
5,501,375 A 3/1996 Nilson
5,505,344 A 4/1996 Woods
5,523,798 A 6/1996 Hagino et al.
5,524,798 A 6/1996 Stern et al.
5,544,783 A 8/1996 Conigliaro
5,548,010 A 8/1996 Franer
5,549,228 A 8/1996 Brown
5,558,247 A 9/1996 Caso
5,562,235 A 10/1996 Cruysberghs
5,570,813 A 11/1996 Clark, II
5,573,137 A 11/1996 Pauls
5,583,178 A 12/1996 Oxman et al.
5,597,095 A 1/1997 Ferrara, Jr.
5,615,804 A 4/1997 Brown
5,639,026 A 6/1997 Woods
5,641,095 A 6/1997 de Laforcade
5,645,198 A 7/1997 Stern et al.
5,655,691 A 8/1997 Stern et al.
5,695,788 A 12/1997 Woods
5,715,975 A 2/1998 Stern et al.
5,727,736 A 3/1998 Tryon
5,752,631 A 5/1998 Yabuno et al.
5,775,432 A 7/1998 Burns et al.
5,792,465 A 8/1998 Hagarty
5,799,879 A 9/1998 Ottl et al.
5,865,351 A 2/1999 De Laforcade
5,868,286 A 2/1999 Mascitelli
5,887,756 A 3/1999 Brown
5,894,964 A 4/1999 Barnes et al.
5,915,598 A 6/1999 Yazawa et al.
5,921,446 A 7/1999 Stern
5,934,518 A 8/1999 Stern et al.
5,941,462 A 8/1999 Sandor
5,957,333 A 9/1999 Losenno et al.
5,975,356 A 11/1999 Yquel et al.
5,988,575 A 11/1999 Lesko
6,000,583 A 12/1999 Stern et al.
6,027,042 A 2/2000 Smith
6,032,830 A 3/2000 Brown
6,039,306 A 3/2000 Pericard et al.
6,062,494 A 5/2000 Mills
6,070,770 A 6/2000 Tada et al.
6,092,698 A 7/2000 Bayer
6,095,435 A 8/2000 Greer, Jr. et al.
6,112,945 A 9/2000 Woods
6,113,070 A 9/2000 Holzboog
6,116,473 A 9/2000 Stern et al.
6,129,247 A 10/2000 Thomas et al.
6,131,777 A 10/2000 Warby
6,139,821 A 10/2000 Fuerst et al.
6,152,335 A 11/2000 Stern et al.
6,161,735 A 12/2000 Uchiyama et al.
6,168,093 B1 1/2001 Greer, Jr. et al.
6,170,717 B1 1/2001 Di Giovanni et al.
D438,111 S 2/2001 Woods
6,225,393 B1 5/2001 Woods
6,254,015 B1 7/2001 Abplanalp
6,257,503 B1 7/2001 Baudin
6,261,631 B1 7/2001 Lomasney et al.
6,265,459 B1 7/2001 Mahoney et al.
6,276,570 B1 8/2001 Stern et al.
6,283,171 B1 9/2001 Blake
6,284,077 B1 9/2001 Lucas et al.
6,290,104 B1 9/2001 Bougamont et al.
6,291,536 B1 9/2001 Taylor
6,296,155 B1 10/2001 Smith
6,296,156 B1 10/2001 Lasserre et al.
6,299,679 B1 10/2001 Montoya
6,299,686 B1 10/2001 Mills
6,315,152 B1 11/2001 Kalisz
6,325,256 B1 12/2001 Liljeqvist et al.
6,328,185 B1 12/2001 Stern et al.
6,328,197 B1 12/2001 Gapihan
6,333,365 B1 12/2001 Lucas et al.
6,352,184 B1 3/2002 Stern et al.
6,362,302 B1 3/2002 Boddie
6,375,036 B1 4/2002 Woods
6,382,474 B1 5/2002 Woods et al.
6,386,402 B1 5/2002 Woods
6,394,321 B1 5/2002 Bayer

(56) References Cited

U.S. PATENT DOCUMENTS 6,394,364 B1 5/2002 Abplanalp
6,395,794 B2 5/2002 Lucas et al.
6,398,082 B2 6/2002 Clark et al.
6,399,687 B2 6/2002 Woods
6,414,044 B2 7/2002 Taylor
6,415,964 B2 7/2002 Woods
6,439,430 B1 8/2002 Gilroy, Sr. et al.
6,446,842 B2 9/2002 Stern et al.
D464,395 S 10/2002 Huang
6,474,513 B2 11/2002 Burt
6,478,198 B2 11/2002 Haroian
6,478,561 B2 11/2002 Braun et al.
6,482,392 B1 11/2002 Zhou et al.
D468,980 S 1/2003 Woods
6,510,969 B2 1/2003 Di Giovanni et al.
6,520,377 B2 2/2003 Yquel
6,531,528 B1 3/2003 Kurp
6,536,633 B2 3/2003 Stern et al.
6,581,807 B1 6/2003 Mekata
6,588,628 B2 7/2003 Abplanalp et al.
6,595,393 B1 7/2003 Loghman-Adham et al.
6,607,106 B2 * 8/2003 Henry et al. ..... 222/402.1
6,613,186 B2 9/2003 Johnson
6,615,827 B2 9/2003 Greenwood et al.
6,637,627 B1 10/2003 Liljeqvist et al.
6,641,005 B1 11/2003 Stern et al.
6,641,864 B2 11/2003 Woods
6,652,704 B2 11/2003 Green
6,659,312 B1 12/2003 Stern et al.
6,666,352 B1 12/2003 Woods
6,688,492 B2 2/2004 Jaworski et al.
6,712,238 B1 3/2004 Mills
6,726,066 B2 4/2004 Woods
6,736,288 B1 5/2004 Green
6,758,373 B2 7/2004 Jackson et al.
6,797,051 B2 9/2004 Woods
6,802,461 B2 10/2004 Schneider
6,831,110 B2 12/2004 Ingold et al.
6,832,704 B2 12/2004 Smith
6,837,396 B2 1/2005 Jaworski et al.
6,843,392 B1 1/2005 Walker
D501,538 S 2/2005 Zeng
D501,914 S 2/2005 Chen
6,848,601 B2 2/2005 Greer, Jr.
6,851,575 B2 2/2005 van't Hoff
D502,533 S 3/2005 Chen
6,880,733 B2 4/2005 Park
6,883,688 B1 4/2005 Stern et al.
6,894,095 B2 5/2005 Russo et al.
6,905,050 B1 6/2005 Stern et al.
6,910,608 B2 6/2005 Greer, Jr. et al.
6,913,407 B2 7/2005 Greer et al.
6,926,178 B1 8/2005 Anderson
6,929,154 B2 8/2005 Grey et al.
6,932,244 B2 8/2005 Meshberg
6,966,467 B2 11/2005 Di Giovanni et al.
D512,309 S 12/2005 Geier
6,971,353 B2 12/2005 Heinze et al.
6,971,553 B2 12/2005 Brennan et al.
6,978,916 B2 12/2005 Smith
6,978,947 B2 12/2005 Jin
6,981,616 B2 1/2006 Loghman-Adham et al.
7,014,073 B1 3/2006 Stern et al.
7,014,127 B2 3/2006 Valpey, III et al.
7,036,685 B1 5/2006 Green
7,045,008 B2 5/2006 Langford
7,059,497 B2 6/2006 Woods
7,059,546 B2 6/2006 Ogata et al.
7,063,236 B2 6/2006 Greer, Jr. et al.
7,104,424 B2 9/2006 Kolanus
7,104,427 B2 9/2006 Pericard et al.
7,121,434 B1 10/2006 Caruso
7,163,962 B2 1/2007 Woods
7,182,227 B2 2/2007 Poile et al.
7,189,022 B1 3/2007 Greer, Jr. et al.
7,192,985 B2 3/2007 Woods
7,204,393 B2 4/2007 Strand
7,226,001 B1 6/2007 Stern et al.
7,226,232 B2 6/2007 Greer, Jr. et al.
7,232,047 B2 6/2007 Greer, Jr. et al.
7,237,697 B2 7/2007 Dunne
7,240,857 B1 7/2007 Stern et al.
7,249,692 B2 7/2007 Walters et al.
7,261,225 B2 8/2007 Rueschhoff et al.
7,267,248 B2 9/2007 Yerby et al.
7,278,590 B1 10/2007 Greer, Jr. et al.
7,303,152 B2 12/2007 Woods
7,307,053 B2 12/2007 Tasz et al.
7,337,985 B1 3/2008 Greer, Jr. et al.
7,341,169 B2 3/2008 Bayer
7,350,676 B2 4/2008 Di Giovanni et al.
7,374,068 B2 5/2008 Greer, Jr.
7,383,968 B2 6/2008 Greer, Jr. et al.
7,383,970 B2 6/2008 Anderson
7,445,166 B2 11/2008 Williams
7,448,517 B2 11/2008 Shieh et al.
7,481,338 B1 1/2009 Stern et al.
7,487,891 B2 2/2009 Yerby et al.
7,487,893 B1 2/2009 Greer, Jr. et al.
7,494,075 B2 2/2009 Schneider
7,500,621 B2 3/2009 Tryon et al.
7,510,102 B2 3/2009 Schmitt
7,556,841 B2 7/2009 Kimball et al.
D600,119 S 9/2009 Sweeton
7,588,171 B2 9/2009 Reedy et al.
7,597,274 B1 10/2009 Stern et al.
7,600,659 B1 10/2009 Greer, Jr. et al.
7,624,932 B1 12/2009 Greer, Jr. et al.
7,631,785 B2 12/2009 Paas et al.
7,641,079 B2 1/2010 Lott et al.
7,673,816 B1 3/2010 Stern et al.
7,677,420 B1 3/2010 Greer, Jr. et al.
7,699,190 B2 4/2010 Hygema
7,721,920 B2 5/2010 Ruiz De Gopegui et al.
7,744,299 B1 6/2010 Greer, Jr. et al.
7,748,572 B2 7/2010 Althoff et al.
7,757,905 B2 7/2010 Strand et al.
7,766,196 B2 8/2010 Sugano et al.
7,775,408 B2 8/2010 Yamamoto et al.
7,784,647 B2 8/2010 Tourigny
7,784,649 B2 8/2010 Greer, Jr.
7,789,278 B2 9/2010 Ruiz de Gopegui et al.
7,845,523 B1 12/2010 Greer, Jr. et al.
7,854,356 B2 12/2010 Eberhardt
7,861,894 B2 1/2011 Walters et al.
7,886,995 B2 2/2011 Togashi
7,891,529 B2 2/2011 Paas et al.
7,913,877 B2 3/2011 Neuhalfen
7,922,041 B2 4/2011 Gurrisi et al.
7,926,741 B2 4/2011 Laidler et al.
8,840,038 B2 9/2014 Lehr
2002/0003147 A1 1/2002 Corba
2002/0100769 A1 8/2002 McKune
2003/0134973 A1 7/2003 Chen et al.
2003/0205580 A1 11/2003 Yahav
2004/0141797 A1 7/2004 Garabedian et al.
2004/0154264 A1 8/2004 Colbert
2004/0157960 A1 8/2004 Rowe
2005/0121474 A1 6/2005 Lasserre et al.
2005/0236436 A1 10/2005 Woods
2005/0256257 A1 11/2005 Betremieux et al.
2006/0049205 A1 3/2006 Green
2006/0180616 A1 8/2006 Woods
2006/0219808 A1 10/2006 Woods
2006/0219811 A1 10/2006 Woods
2006/0273207 A1 12/2006 Woods
2007/0117916 A1 5/2007 Anderson et al.
2007/0119984 A1 5/2007 Woods
2007/0125879 A1 6/2007 Khamenian
2007/0155892 A1 7/2007 Gharapetian et al.
2007/0178243 A1 8/2007 Houck et al.
2007/0194040 A1 8/2007 Tasz et al.
2007/0219310 A1 9/2007 Woods
2007/0228086 A1 10/2007 Delande et al.

(56) References Cited

U.S. PATENT DOCUMENTS

| | | | |
|---|---|---|---|
| 2007/0260011 | A1 | 11/2007 | Woods |
| 2007/0272765 | A1 | 11/2007 | Kwasny |
| 2007/0272768 | A1 | 11/2007 | Williams et al. |
| 2008/0008678 | A1 | 1/2008 | Wyers |
| 2008/0017671 | A1 | 1/2008 | Shieh et al. |
| 2008/0029551 | A1 | 2/2008 | Lombardi |
| 2008/0033099 | A1 | 2/2008 | Bosway |
| 2008/0041887 | A1 | 2/2008 | Scheindel |
| 2008/0164347 | A1 | 7/2008 | Leuliet et al. |
| 2009/0020621 | A1 | 1/2009 | Clark et al. |
| 2009/0283545 | A1 | 11/2009 | Kimball |
| 2010/0108716 | A1 | 5/2010 | Bilko |
| 2010/0155432 | A1 | 6/2010 | Christianson |
| 2010/0200612 | A1 | 8/2010 | Smith |
| 2010/0322892 | A1 | 12/2010 | Burke |
| 2011/0021675 | A1 | 1/2011 | Shigemori et al. |
| 2011/0101025 | A1 | 5/2011 | Walters et al. |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2224042 | 6/1999 |
| CA | 2291599 | 6/2000 |
| CA | 2381994 | 2/2001 |
| CA | 2327903 | 6/2001 |
| CA | 2065534 | 8/2003 |
| CA | 2448794 | 12/2004 |
| CA | 2504509 | 10/2005 |
| CA | 2504513 | 10/2005 |
| CH | 680849 | 11/1992 |
| DE | 1926796 | 3/1970 |
| DE | 3808438 | 4/1989 |
| DE | 3806991 | 9/1989 |
| EP | 2130788 | 12/2009 |
| FR | 463476 | 2/1914 |
| FR | 84727 | 9/1965 |
| FR | 1586067 | 2/1970 |
| FR | 2659847 | 9/1991 |
| GB | 867713 | 5/1961 |
| GB | 970766 | 9/1964 |
| GB | 977860 | 12/1964 |
| GB | 1144385 | 3/1969 |
| GB | 2418959 | 12/2006 |
| JP | 461392 | 1/1971 |
| JP | 55142073 | 11/1980 |
| JP | 8332414 | 12/1996 |
| WO | 9418094 | 8/1994 |
| WO | 2005087617 | 9/2005 |
| WO | 2005108240 | 11/2005 |
| WO | 2006090229 | 8/2006 |
| WO | 2008060157 | 5/2008 |

OTHER PUBLICATIONS

Chadwick, "Controlling Particle Size in Self-Pressurized Aerosol Packages," Metal Finishing, Aug. 2004, 3 pages, vol. 102, No. 7/8.

Homax Products, Inc., "Easy Touch Spray Texture Brochure", Mar. 1992, 1 page.

Newman-Green, Inc., "Aerosol Valves, Sprayheads & Accessories Catalog", Apr. 1, 1992, pp. 14, 20, and 22.

Tait, "An Introduction to Electrochemical Corrosion Testing for Practicing Engineers and Scientists," 1994, 17 pages, PairODocs Publications, Racine, Wisconsin.

* cited by examiner

ACTUATORS FOR DISPENSERS FOR TEXTURE MATERIAL

RELATED APPLICATIONS

This application, U.S. patent application Ser. No. 13/897,178 filed May 17, 2013, claims benefit of U.S. Provisional Patent Application Ser. No. 61/648,519 filed May 17, 2012.

TECHNICAL FIELD

The outlet opening 326 is defined by the first, second, and third inner surfaces 380, 382, and 384 of the adjustment member 332 and, in the first configuration illustrated in FIG. 4A, by the side surface 352. In the second configuration illustrated in FIG. 4B, the outlet opening 326 is defined by the first, second, and third inner surfaces 380, 382, and 384 of the adjustment member 332, by the side surface 352, by portions of the first and second opposing surfaces 354 and 356. In both the first and second configurations shown in FIGS. 4A and 4B, the outlet opening 326 is circular or oval in overall configuration.

BACKGROUND

The present invention generally relates to systems and methods for applying texture material to an interior surface such as a wall or ceiling. In particular, buildings are typically constructed with a wood or metal framework. To form interior wall and ceiling surfaces, drywall material is attached to the framework. Typically, at least one primer layer and at least one paint layer is applied to the surface of the drywall material to form a finished wall surface.

For aesthetic and other reasons, a bumpy or irregular texture layer is often formed on the drywall material after the drywall material has been primed and before it has been painted. The appearance of the texture layer can take a number of patterns. As its name suggests, an "orange peel" texture pattern generally has the appearance of the surface of an orange and is formed by a spray of relatively small droplets of texture material applied in a dense, overlapping pattern. A "splatter" texture pattern is formed by larger, more spaced out droplets of texture material. A "knockdown" texture patter is formed by spraying texture material in larger droplets (like a "splatter" texture pattern) and then lightly working the surfaces of the applied droplets with a knife or scraper so that the highest points of the applied droplets are flattened. In some situations, a visible aggregate material such as polystyrene chips is added to the texture material to form what is commonly referred to as an "acoustic" or "popcorn" texture pattern.

For larger applications, such as a whole room or structure, the texture layer is typically initially formed using a commercial texture sprayer. Commercial texture sprayers typically comprise a spray gun, a hopper or other source of texture material, and a source of pressurized air. The texture material is mixed with a stream of pressurized air within the texture gun, and the stream of pressurized air carries the texture material in droplets onto the target surface to be textured. Commercial texture sprayers contain numerous points of adjustment (e.g., amount of texture material, pressure of pressurized air, size of outlet opening, etc.) and thus allow precise control of the texture pattern and facilitate the quick application of texture material to large surface areas. However, commercial texture sprayers are expensive and can be difficult to set up, operate, and clean up, especially for small jobs where overspray may be a problem.

For smaller jobs and repairs, especially those performed by non-professionals, a number of "do-it-yourself" (DIY) products for applying texture material are currently available in the market. Perhaps the most common type of DIY texturing products includes aerosol systems that contain texture material and a propellant. Aerosol systems typically include a container, a valve, and an actuator. The container contains the texture material and propellant under pressure. The valve is mounted to the container selectively to allow the pressurized propellant to force the texture material out of the container. The actuator defines an outlet opening, and, when the actuator is depressed to place the valve in an open configuration, the pressurized propellant forces the texture material out of the outlet opening in a spray. The spray typically approximates only one texture pattern, so it was difficult to match a variety of perhaps unknown preexisting texture patterns with original aerosol texturing products.

A relatively crude work around for using an aerosol texturing system to apply more than one texture pattern is to reduce the pressure of the propellant material within the container prior to operating the valve. In particular, when maintained under pressure within the container, typical propellant materials exist in both a gas phase and in a liquid phase. The propellant material in the liquid phase is mixed with the texture material, and the texture material in the gas state pressurizes the mixture of texture material and liquid propellant material. When the container is held upright, the liquid contents of the container are at the bottom of the container chamber, while the gas contents of the container collect at the top of the container chamber. A dip tube extends from the valve to the bottom of the container chamber to allow the propellant in the gas phase to force the texture material up from the bottom of the container chamber and out of the outlet opening when the valve is opened. To increase the size of the droplets sprayed out of the aerosol system, the container can be inverted, the valve opened, and the gas phase propellant material allowed to flow out of the aerosol system, reducing pressure within the container chamber. The container is then returned upright and the valve operated again before the pressure of the propellant recovers such that the liquid contents are forced out in a coarser texture pattern. This technique of adjusting the applied texture pattern result in only a limited number of texture patterns that are not highly repeatable and can drain the can of propellant before the texture material is fully dispensed.

A more refined method of varying the applied texture pattern created by aerosol texturing patterns involved adjusting the size of the outlet opening formed by the actuator structure. Initially, it was discovered that the applied texture pattern could be varied by attaching one of a plurality of straws or tubes to the actuator member, where each tube defined an internal bore of a different diameter. The straws or tubes were sized and dimensioned to obtain fine, medium, and coarse texture patterns appropriate for matching a relatively wide range of pre-existing texture patterns. Additional structures such as caps and plates defining a plurality of openings each having a different cross-sectional area could be rotatably attached relative to the actuator member to change the size of the outlet opening. More recently, a class of products has been developed using a resilient member that is deformed to alter the size of the outlet opening and thus the applied texture pattern.

The need thus exists for improved aerosol texturing systems and methods that can approximate the results obtained by commercial texture sprayers.

SUMMARY

The present invention may be embodied as an aerosol dispensing system for dispensing stored material in a spray comprising a container, a conduit, and an adjustment system. The container defines a chamber containing the stored material and pressurized material. The conduit defines a conduit passageway having a conduit inlet and a conduit outlet. The conduit inlet is arranged within the chamber and the conduit outlet is arranged outside of the chamber. An adjustment system is arranged to vary a flow of stored material along the conduit passageway. The adjustment system is arranged adjacent to the conduit outlet and comprises an actuator member and first and second adjustment members. The actuator member forms at least a portion of the conduit and defines at least a portion of the conduit passageway. The first and second adjustment members are supported by the actuator member. The conduit outlet is defined by a first surface of the first adjustment member and a second surface of the second adjustment member. At least one of the first and second adjustment members is movably supported by the actuator member such that moving the first and second adjustment members relative to each other alters a cross-sectional area of the conduit outlet.

The present invention may also be embodied as a method of dispensing stored material in a spray comprising the following steps. A chamber is defined. The stored material and pressurized material are arranged within the chamber. A conduit passageway having a conduit inlet and a conduit outlet is arranged such that the conduit inlet is arranged within the chamber and the conduit outlet is arranged outside of the chamber. An adjustment system comprising an actuator member and first and second adjustment members is provided. The actuator member is arranged to define at least a portion of the conduit passageway. The first and second adjustment members are supported on the actuator member such that the conduit outlet is defined by a first surface of the first adjustment member and a second surface of the second adjustment member. The first and second adjustment members are moved relative to each other to alter a cross-sectional area of the conduit outlet and thereby vary a flow of stored material along the conduit passageway at the conduit outlet.

DETAILED DESCRIPTION

Figure 1:
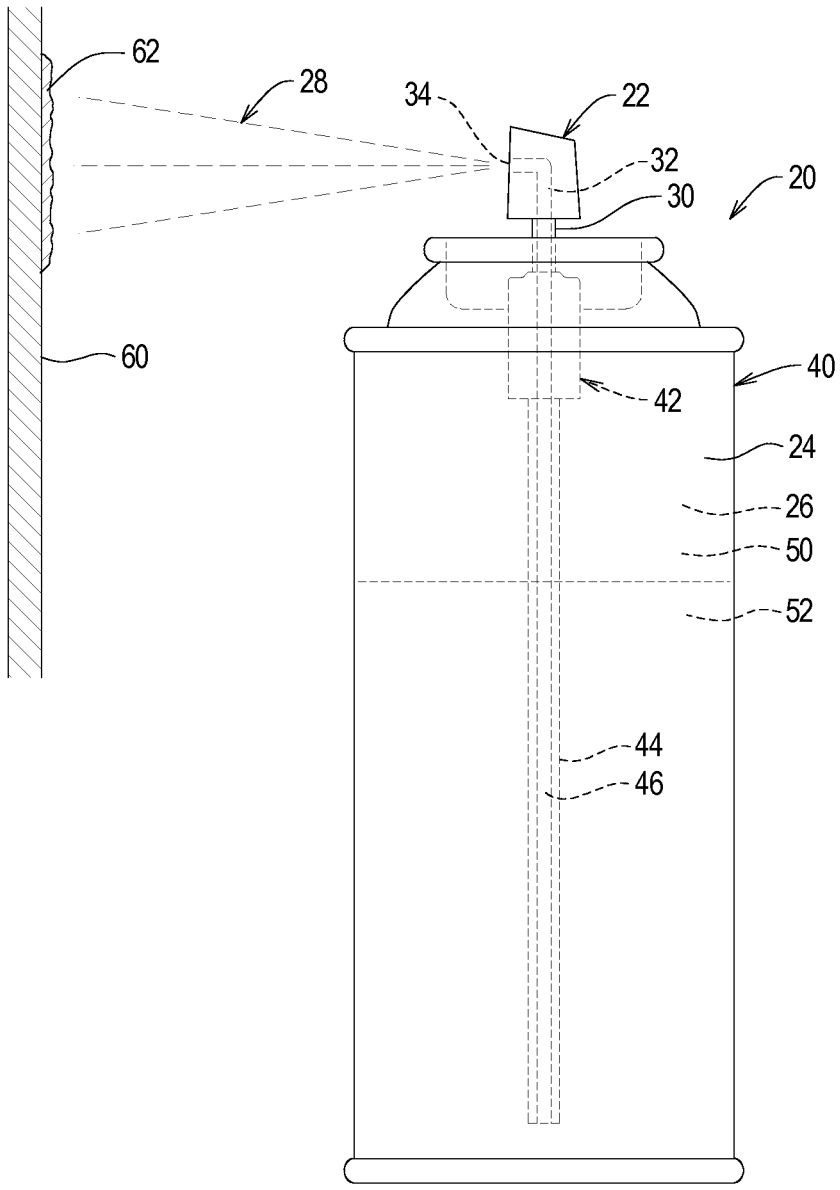
FIG. 1 is a side elevation view of an example dispensing system for texture material of the type that employs an actuator of the present invention.

Referring initially to FIG. 1 of the drawing, depicted at 20 therein is an example dispensing system 20 employing an actuator 22 that may implement the principles of the present invention. In addition to the actuator, the dispensing system 20 comprises an aerosol system 24 that contains a contained material 26. The dispensing system 20 dispenses the contained material in a spray 28 as shown in FIG. 1.

The actuator 22 comprises a stem portion 30 and defines an actuator passageway 32. The actuator passageway 32 terminates in an outlet opening 34. The aerosol system 24 comprises a container system 40, a valve system 42, and a dip tube 44 and defines a dispensing passageway 46 from the interior of the container system 40 to the exterior of the aerosol system 24. The container system 40 and the valve system 42 are or may be conventional and will not be described herein beyond what is necessary for a complete understanding of the principles of the present invention.

The stem portion 30 of the actuator 22 engages the valve system 42 to support the actuator 22 relative to the aerosol system 24. The valve system 42 is operable in a normally closed configuration in which fluid is substantially prevented from flowing along the dispensing passageway 46 and an open configuration in which fluid is allowed to flow along the dispensing passageway 46. Displacing the actuator 22 relative to the container system 40 causes the valve system 42 to change from the normally closed configuration to the open configuration.

The contained material 26 comprises a propellant material and a texture material and defines a gas portion 50 and a liquid portion 52. The propellant material defines at least a portion of the gas portion 50, and the texture material defines at least a portion of the liquid portion 52. In one example, the propellant material is a compressed inert gas such as air or nitrogen, in which case the propellant material defines the gas portion 50 and the texture material defines the liquid portion 52. In another example, the propellant material is a bi-phase material that exists within the container system 40 in both liquid and gas phases. In this second example, the liquid phase of the propellant material defines the gas portion 50, and the liquid portion 52 comprises both the texture material and the liquid phase of the propellant material.

The gas portion 50 pressurizes the liquid portion 52 such that operation of the valve system 42 in the open configuration allows the gas portion 50 to force at least part of the liquid portion 52 out of the aerosol system 24 through the actuator 22 as the spray 28. The spray 28 comprises texture material and possibly some of the propellant material in liquid phase. If the spray 28 comprises propellant material in liquid phase, the propellant material within the spray gasifies when released from the container system 40. If the spray 28 contains gasifying propellant material, the expanding propellant material within the spray 28 can assist with atomization of the spray 28. In any event, the spray is deposited on a surface 60 to form a texture layer 62 having bumps and irregularities. The dimensions and/or shape of the cross-sectional area defined by the outlet opening 34 define the characteristics of the spray 28 and thus the bumps and irregularities of the texture layer 62.

Figure 2A:
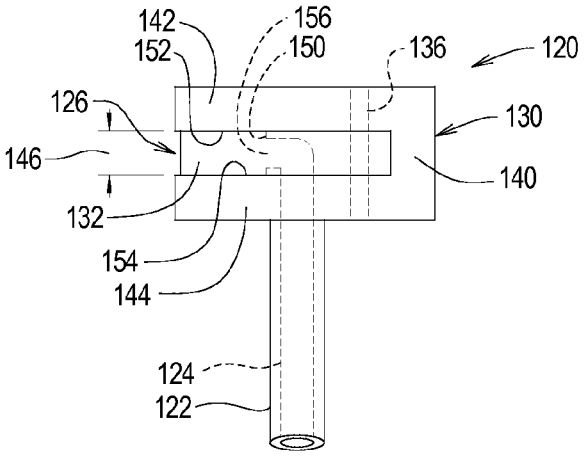
FIG. 2A is a side section view of a first example actuator of the present invention.
Figure 2B:
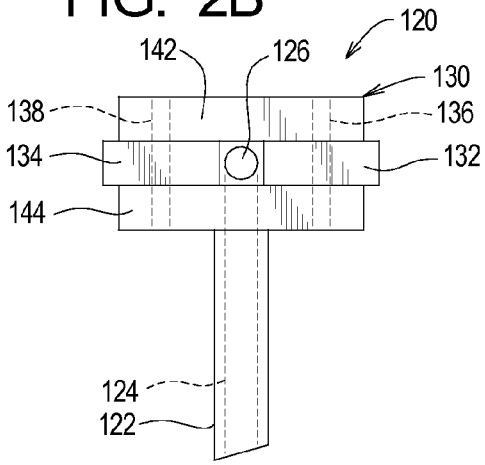
FIG. 2B is a front elevation view of the first example actuator in a first configuration.
Figure 2C:
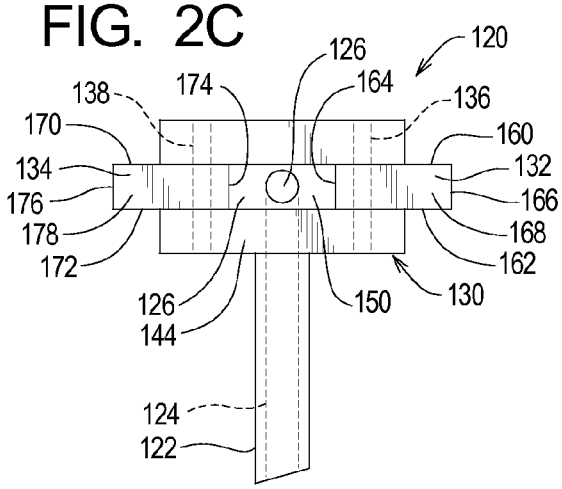
FIG. 2C is a front elevation view of the first example actuator in a second configuration.

Turning now to FIGS. 2A-2C of the drawing, depicted therein is a first example actuator 120 that may be used as the actuator 22 of the dispensing system 20. The actuator 120 comprises a stem portion 122 and defines an actuator passageway 124 and an outlet opening 126. The first example actuator 120 comprises a base member 130, a first plate 132, a second plate 134, a first pin 136, and a second pin 138. The base member 130 comprises a main portion 140, a first wall portion 142, and a second wall portion 144 and defines a slot 146. The main portion 140 defines a main surface 150, the first wall portion 142 defines a first opposing surface 152, and the second wall portion 144 defines a second opposing surface 154. The actuator passageway 124 terminates in an inner opening 156 formed in the main surface 150.

The first plate 132 defines a first plate upper surface 160, a first plate lower surface 162, a first plate inner surface 164, a first plate outer surface 166, and a first plate end surface 168. The second plate 134 defines a second plate upper surface 170, a second plate lower surface 172, a second plate inner surface 174, a second plate outer surface 176, and a second plate end surface 178.

The first and second plates 132 and 134 are sized and dimensioned to fit snugly within the slot 146 such that the upper surfaces 160 and 170 engage the first opposing surface 152 and the lower surfaces 162 and 172 engage the second opposing surface 154. The first pin 136 extends through the first wall portion 142, the first plate 132, and the second wall portion 144 to movably attach the first plate 132 to the base member 130. The second pin 138 extends through the first wall portion 142, the second plate 134, and the second wall portion 144 to movably attach the second plate 134 to the base member 130.

The outlet opening 126 is defined by the first and second opposing surfaces 152 and 154 of the base member 130 and the first and second inner surfaces 164 and 174 of the first and second plates 132 and 134. By moving one or both of the plates 132 and 134 relative to the base member 130, a cross-sectional area of the outlet opening 126 may be changed as can be seen by a comparison of FIGS. 2B and 2C. When the liquid portion 52 of the contained material 26 is forced through the actuator passageway 124 and the inner opening 156, the characteristics of the spray 28 formed by the liquid portion 52 are defined by the outlet opening 126 formed as described above. The characteristics of the texture layer 62 formed by the spray 28 can thus be altered by changing the outlet opening 126 as defined above.

Figure 3A:
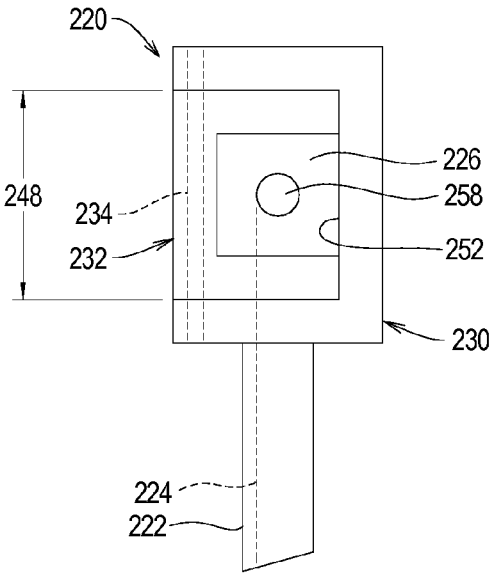
FIG. 3A is a front elevation view of a second example actuator in a first configuration.
Figure 3B:
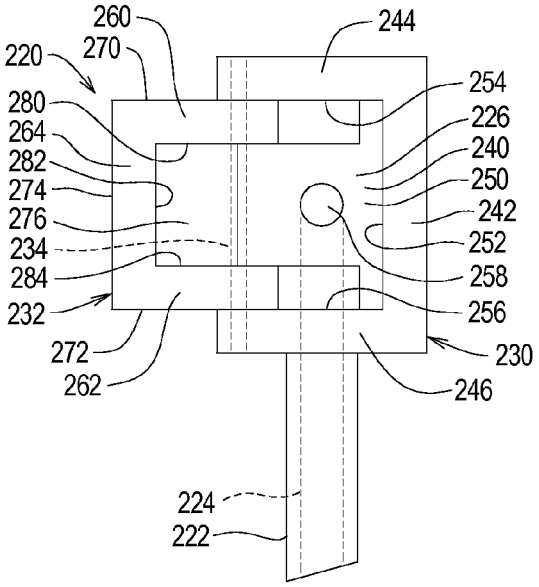
FIG. 3B is a front elevation view of the second example actuator in a second configuration.

Turning next to FIGS. 3A and 3B of the drawing, depicted therein is a second example actuator 220 that may be used as the actuator 22 of the dispensing system 20. The actuator 220 comprises a stem portion 222 and defines an actuator passageway 224 and an outlet opening 226. The second example actuator 220 comprises a base member 230, an adjustment member 232, and a pin 234. The base member 230 comprises a main portion 240, a first wall portion 242, a second wall portion 244, and a third wall portion 246 and defines a slot 248. The main portion 240 defines a main surface 250, the first wall portion 242 defines a side surface 252, the second wall portion 244 defines a first opposing surface 254, and the third wall portion 246 defines a second opposing surface 256. The actuator passageway 224 terminates in an inner opening 258 formed in the main surface 250.

The adjustment member 232 defines a first wall portion 260, a second wall portion 262, and a third wall portion 264. The first wall portion 260 defines an upper surface 270, the second wall portion 262 defines a lower surface 272, and the third wall portion 264 defines an outer surface 274. The adjustment member 232 further defines an end surface 276. In addition, the first wall portion 260 defines a first inner surface 280, the second wall portion 262 defines a second inner surface 282, and the third wall portion 264 defines a third inner surface 284.

The adjustment member 232 is sized and dimensioned to fit snugly within the slot 248 such that the upper surface 270 engages the first opposing surface 254 and the lower surface 272 engages the second opposing surface 256. The pin 234 extends through the second wall portion 244, the adjustment member 232, and the third wall portion 246 to movably attach the adjustment member 232 to the base member 230.

The outlet opening 226 is defined by the first, second, and third inner surfaces 280, 282, and 284 of the adjustment member 232 and, in the first configuration illustrated in FIG. 3A, by the side surface 252. In the second configuration illustrated in FIG. 3B, the outlet opening 226 is defined by the first, second, and third inner surfaces 280, 282, and 284 of the adjustment member 232, by the side surface 252, by portions of the first and second opposing surfaces 254 and 256. In both the first and second configurations shown in FIGS. 3A and 3B, the outlet opening 226 is rectangular in overall configuration.

Accordingly, by moving the adjustment member 232 relative to the base member 230, a cross-sectional area of the outlet opening 226 may be changed as can be seen by a comparison of FIGS. 3A and 3B. When the liquid portion 52 of the contained material 26 is forced through the actuator passageway 224 and the inner opening 258, the characteristics of the spray 28 formed by the liquid portion 52 are defined by the outlet opening 226 formed as described above. The characteristics of the texture layer 62 formed by the spray 28 can thus be altered by changing the outlet opening 226 as defined above.

Figure 4A:
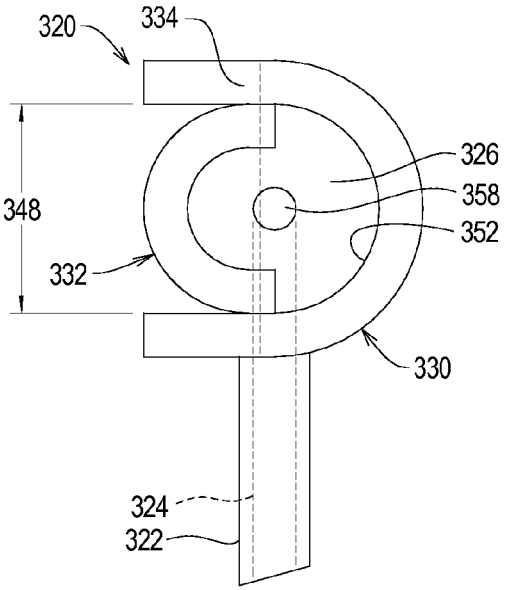
FIG. 4A is a front elevation view of a third example actuator in a first configuration.
Figure 4B:
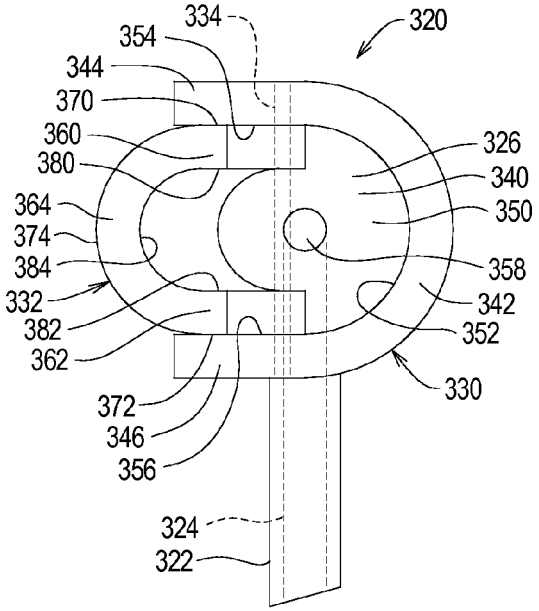
FIG. 4B is a front elevation view of the third example actuator in a second configuration.

FIGS. 4A and 4B illustrate a third example actuator 320 that may be used as the actuator 22 of the dispensing system 20. The actuator 320 comprises a stem portion 322 and defines an actuator passageway 324 and an outlet opening 326. The third example actuator 320 comprises a base member 330, an adjustment member 332, and a pin 334. The base member 330 comprises a main portion 340, a first wall portion 342, a second wall portion 344, and a third wall portion 346 and defines a slot 348. The main portion 340 defines a main surface 350, the first wall portion 342 defines a side surface 352, the second wall portion 344 defines a first opposing surface 354, and the third wall portion 346 defines a second opposing surface 356. The actuator passageway 324 terminates in an inner opening 358 formed in the main surface 350.

The adjustment member 332 defines a first wall portion 360, a second wall portion 362, and a third wall portion 364. The first wall portion 360 defines an upper surface 370, the second wall portion 362 defines a lower surface 372, and the third wall portion 364 defines an outer surface 374. The adjustment member 332 further defines an end surface 376. In addition, the first wall portion 360 defines a first inner surface 380, the second wall portion 362 defines a second inner surface 382, and the third wall portion 364 defines a third inner surface 384.

The adjustment member 332 is sized and dimensioned to fit snugly within the slot 348 such that the upper surface 370 engages the first opposing surface 354 and the lower surface 372 engages the second opposing surface 356. The pin 334 extends through the second wall portion 344, the adjustment member 332, and the third wall portion 346 to movably attach the adjustment member 332 to the base member 330.

The outlet opening 326 is defined by the first, second, and third inner surfaces 380, 382, and 384 of the adjustment member 332 and, in the first configuration illustrated in FIG. 3A, by the side surface 352. In the second configuration illustrated in FIG. 3B, the outlet opening 326 is defined by the first, second, and third inner surfaces 380, 382, and 384 of the adjustment member 332, by the side surface 352, by portions of the first and second opposing surfaces 354 and 356. In both the first and second configurations shown in FIGS. 4A and 4B, the outlet opening 326 is circular or oval in overall configuration.

Accordingly, by moving the adjustment member 332 relative to the base member 330, a cross-sectional area of the outlet opening 326 may be changed as can be seen by a comparison of FIGS. 4A and 4B. When the liquid portion 52 of the contained material 26 is forced through the actuator passageway 324 and the inner opening 358, the characteristics of the spray 28 formed by the liquid portion 52 are defined by the outlet opening 326 formed as described above. The characteristics of the texture layer 62 formed by the spray 28 can thus be altered by changing the outlet opening 326 as defined above.

Figure 5A:
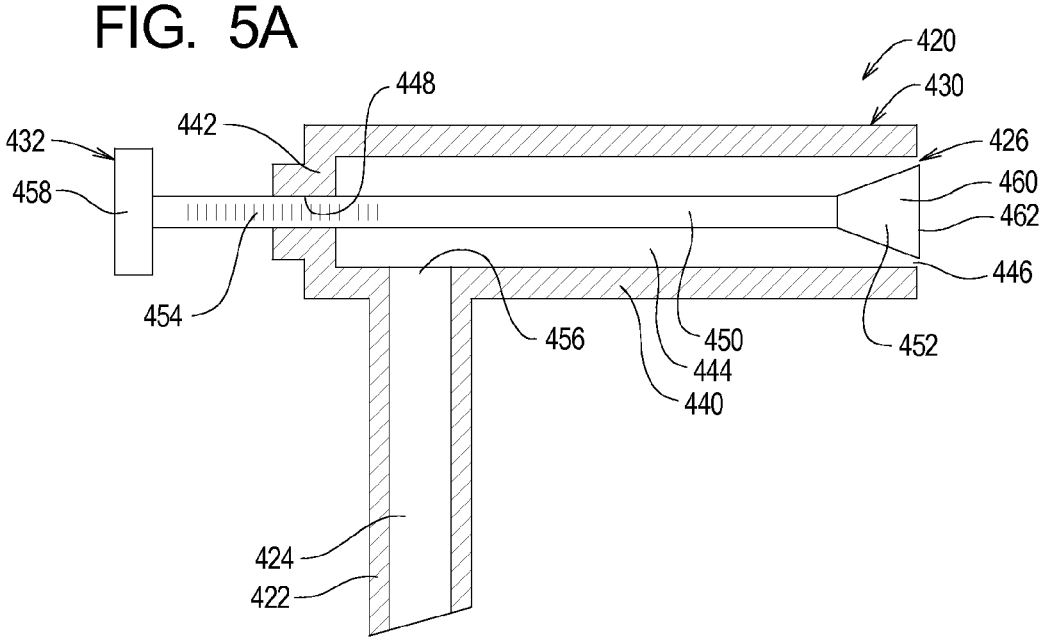
FIG. 5A is a side elevation section view of a fourth example actuator in a first configuration.
Figure 5B:
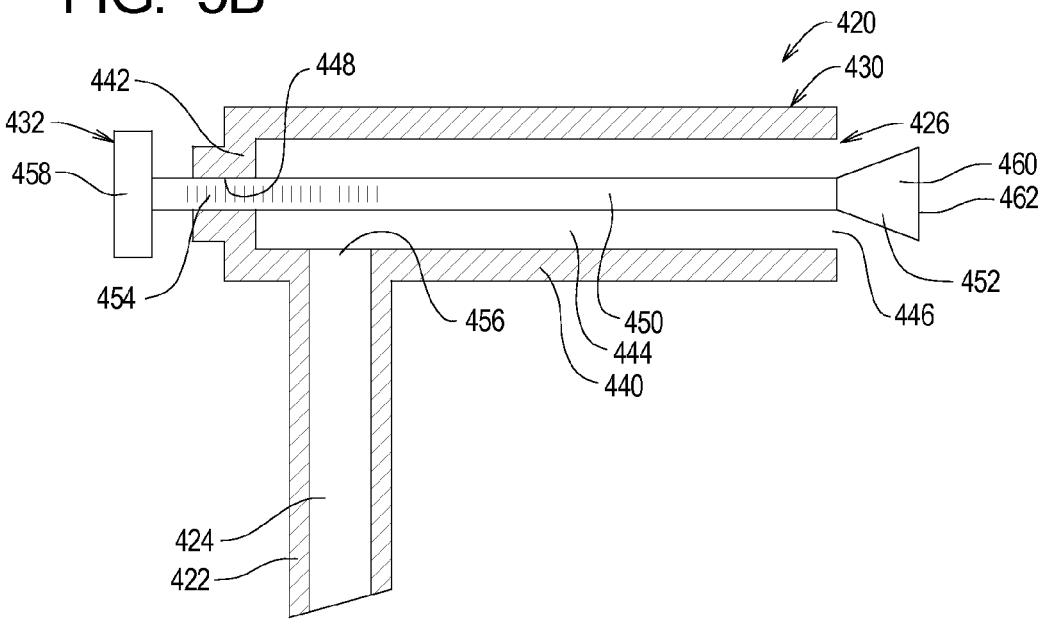
FIG. 5B is a side elevation section view of the fourth example actuator in a second configuration.

FIGS. 5A and 5B illustrate a fourth example actuator 420 that may be used as the actuator 22 of the dispensing system 20. The actuator 420 comprises a stem portion 422 and defines an actuator passageway 424 and an outlet opening 426. The fourth example actuator 420 comprises a base member 430, and an adjustment member 432. The base member 430 comprises an outlet wall 440, a back wall 442, an outlet chamber 444, an end opening 446, a threaded opening 448, and an inner opening 456. The adjustment member 432 defines a shaft portion 450, an end portion 452, and a threaded portion 454. Optionally, a handle portion 458 may be attached to the shaft portion 450.

The adjustment member 432 is sized and dimensioned such that the threaded portion 454 engages the threaded opening 448 such that the end portion 452 is adjacent to the end opening 446 of the base member 430. The threaded portion 454 further engages the threaded opening 448 such that axial rotation of the adjustment member 432 causes movement of the adjustment member 432 relative to the base member 430.

The end portion 452 of the adjustment member 432 further defines an inner surface 460 and an outer surface 462. The inner surface 460 is shaped such that a diameter thereof becomes larger along a longitudinal axis of the adjustment member 432 from the shaft portion 450 to the end surface 462. In the example depicted in FIGS. 5A and 5B, the inner surface 460 is frustoconical.

The outlet opening 426 is defined by the inner surfaces 460 of the adjustment member 432 and by the end opening 446 of the base member 430. In particular, axial rotation of the adjustment member 432 causes the adjustment member 432 to move or be displaced relative to the base member 430 as shown by a comparison of FIGS. 5A and 5B. In both the first and second configurations shown in FIGS. 5A and 5B, the outlet opening 426 is annular in overall configuration, but the surface area of the annular space forming the outlet opening 426 is larger in FIG. 5B than in FIG. 5A.

Accordingly, by moving the adjustment member 432 relative to the base member 430, a cross-sectional area of the outlet opening 426 may be changed as can be seen by a comparison of FIGS. 5A and 5B. When the liquid portion 52 of the contained material 26 is forced through the actuator passageway 424 and the inner opening 456, the characteristics of the spray 28 formed by the liquid portion 52 are defined by the outlet opening 426 formed as described above. The characteristics of the texture layer 62 formed by the spray 28 can thus be altered by changing the outlet opening 426 as defined above.

Figure 6A:
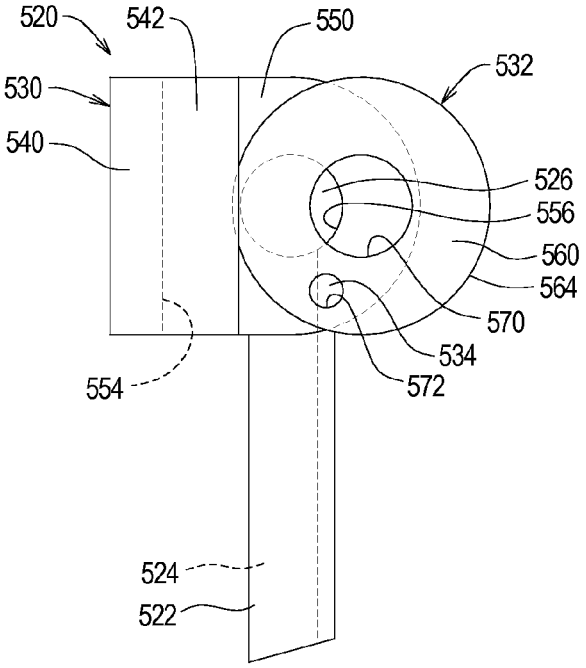
FIG. 6A is a front elevation view of a fifth example actuator in a first configuration.
Figure 6B:
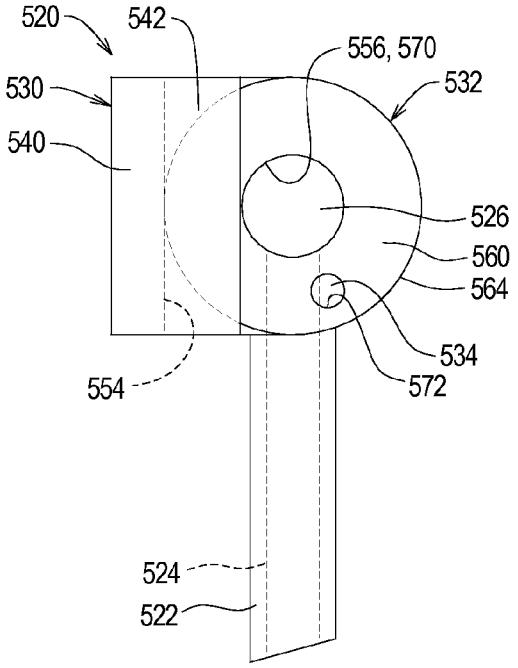
FIG. 6B is a front elevation view of the fifth example actuator in a second configuration.
Figure 6C:
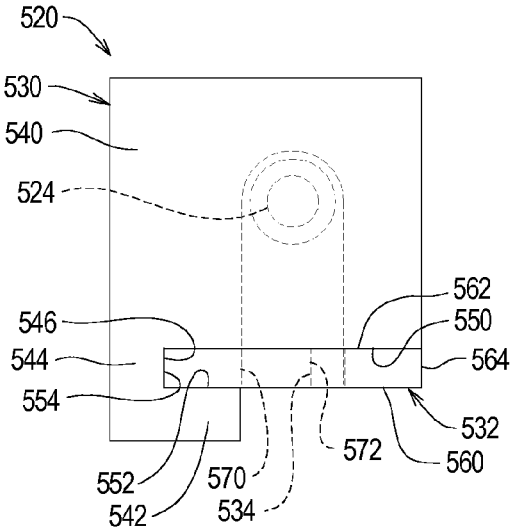
FIG. 6C is a top plan view of the fifth example actuator in a second configuration.

FIGS. 6A, 6B, and 6C illustrate a fifth example actuator 520 that may be used as the actuator 22 of the dispensing system 20. The example actuator 520 comprises a stem portion 522 and defines an actuator passageway 524 and an outlet opening 526. The fifth example actuator 520 comprises a base member 530, an adjustment member 532, and a pin 534. The base member 530 comprises a main portion 540 and, optionally, a front wall portion 542 and a side wall portion 544. The example base member 530 thus defines a groove 546. The main portion 540 defines a main surface 550, the front wall portion 542 defines an opposing surface 552, and the side wall portion 544 defines a stop surface 554. The actuator passageway 524 terminates in an inner opening 556 formed in the main surface 550.

The adjustment member 532 defines a front surface 560, a rear surface 562, and an edge surface 564. The adjustment member 532 further defines a plate opening 570 and a pin opening 572.

The adjustment member 532 is sized and dimensioned such that a portion thereof snugly fits within the groove 546. In particular, the front and rear surfaces 560 and 562 of the adjustment member 532 engage the main surface 550 and the opposing surface 552, respectively. The pin 534 extends through the pin opening 572 to movably attach the adjustment member 532 to the base member 530. The example pin 534 is offset from the inner opening 556 along an axis of the actuator passageway 524 as shown in FIGS. 6A and 6B.

The outlet opening 526 is defined by the overlap of the plate opening 570 and the inner opening 556. In both the first and second configurations shown in FIGS. 6A and 6B, the outlet opening 526 changes both size in terms of cross-sectional area and shape. When the outlet opening 526 is as shown in FIG. 6A, the outlet opening 526 is in the shape of a pointed oval and is approximately 10-20% of the size of the plate opening 570. When the outlet opening 526 is as shown in FIG. 6B, the outlet opening 526 is circular and is approximately 100% of the size of the plate opening 570. The edge surface 564 engages the stop surface 554 when the adjustment member 532 is in the position shown in FIG. 6B. The optional front wall portion 542 helps hold the adjustment member 532 against the main surface 550 but may not be necessary depending upon the circumstances.

Accordingly, by moving the adjustment member 532 relative to the base member 530, both a shape and a cross-sectional area of the outlet opening 526 may be changed as can be seen by a comparison of FIGS. 6A and 6B. When the liquid portion 52 of the contained material 26 is forced through the actuator passageway 524 and the inner opening 556, the characteristics of the spray 28 formed by the liquid portion 52 are defined by the outlet opening 526 formed as described above. The characteristics of the texture layer 62 formed by the spray 28 can thus be altered by changing the outlet opening 526 as defined above.

Figure 7A:
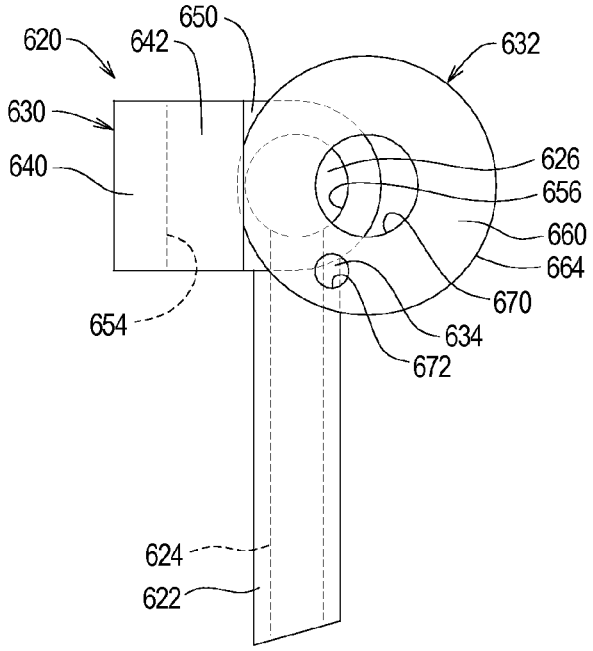
FIG. 7A is a front elevation view of a sixth example actuator in a first configuration.
Figure 7B:
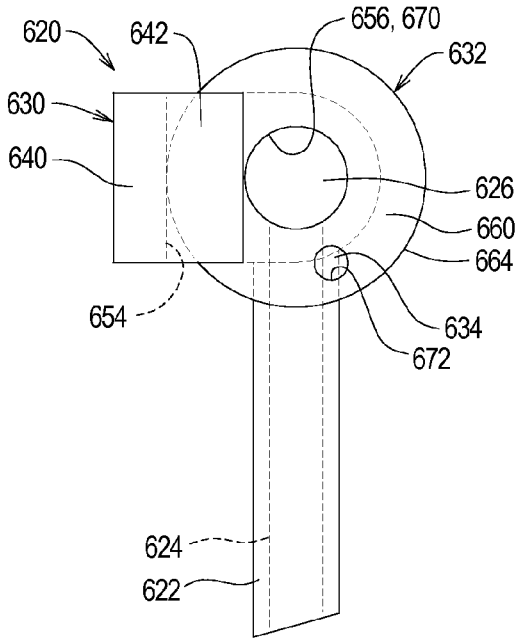
FIG. 7B is a front elevation view of the sixth example actuator in a second configuration.
Figure 7C:
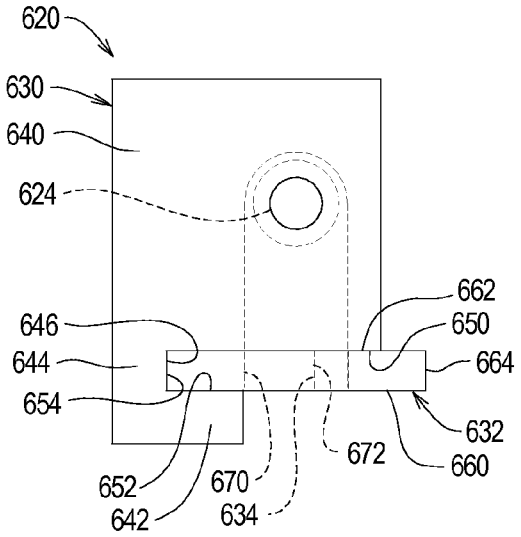
FIG. 7C is a top plan view of the sixth example actuator in a second configuration.

FIGS. 7A, 7B, and 7C illustrate a sixth example actuator 620 that may be used as the actuator 22 of the dispensing system 20. The example actuator 620 comprises a stem portion 622 and defines an actuator passageway 624 and an outlet opening 626. The sixth example actuator 620 comprises a base member 630, an adjustment member 632, and a pin 634. The base member 630 comprises a main portion 640 and, optionally, a front wall portion 642 and a side wall portion 644. The example base member 630 thus defines a groove 646. The main portion 640 defines a main surface 650, the front wall portion 642 defines an opposing surface 652, and the side wall portion 644 defines a stop surface 654. The actuator passageway 624 terminates in an inner opening 656 formed in the main surface 650.

The adjustment member 632 defines a front surface 660, a rear surface 662, and an edge surface 664. The adjustment member 632 further defines a plate opening 670 and a pin opening 672.

The adjustment member 632 is sized and dimensioned such that a portion thereof snugly fits within the groove 646. In particular, the front and rear surfaces 660 and 662 of the adjustment member 632 engage the main surface 650 and the opposing surface 652, respectively. The pin 634 extends through the pin opening 672 to movably attach the adjustment member 632 to the base member 630. The example pin 634 is aligned with the inner opening 656 along an axis of the actuator passageway 624 as shown in FIGS. 7A and 7B.

The outlet opening 626 is defined by the overlap of the plate opening 670 and the inner opening 656. In both the first and second configurations shown in FIGS. 7A and 7B, the outlet opening 626 changes both size in terms of cross-sectional area and shape. When the outlet opening 626 is as shown in FIG. 7A, the outlet opening 626 is in the shape of a pointed oval and is approximately 10-20% of the size of the plate opening 670. When the outlet opening 626 is as shown in FIG. 7B, the outlet opening 626 is circular and is approximately 100% of the size of the plate opening 670. The edge surface 664 engages the stop surface 654 when the adjustment member 632 is in the position shown in FIG. 7B. The optional front wall portion 642 helps hold the adjustment member 632 against the main surface 650 but may not be necessary depending upon the circumstances.

Accordingly, by moving the adjustment member 632 relative to the base member 630, both a shape and a cross-sectional area of the outlet opening 626 may be changed as can be seen by a comparison of FIGS. 7A and 7B. When the liquid portion 62 of the contained material 26 is forced through the actuator passageway 624 and the inner opening 656, the characteristics of the spray 28 formed by the liquid portion 62 are defined by the outlet opening 626 formed as described above. The characteristics of the texture layer 62 formed by the spray 28 can thus be altered by changing the outlet opening 626 as defined above.

FIGS. 8A-8D illustrate a seventh example actuator 720 that may be used as the actuator 22 of the dispensing system 20. The actuator 720 comprises a stem portion 722 and defines an actuator passageway 724 and an outlet opening 726. The seventh example actuator 720 comprises a base member 730 and an adjustment member 732. The base member 730 comprises an outlet wall 740, an outlet chamber 742, and an outer surface 744. The adjustment member 732 defines a front wall 750, a perimeter wall 752, and cavity 754. The front wall 750 defines an inner surface 760, and the perimeter wall 752 defines a perimeter surface 762. The cavity 754 is partly bounded by the inner surface 760 and the perimeter surface 762. First and second adjustment openings 770 and 772 extend through the front wall 750.

Figure 8A:
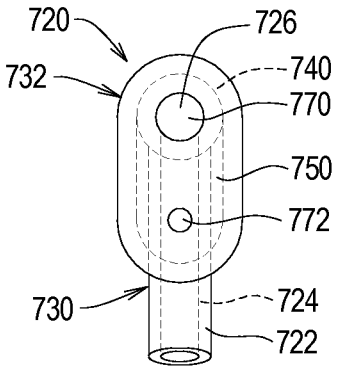
FIG. 8A is a front elevation view of a seventh example actuator.
Figure 8B:
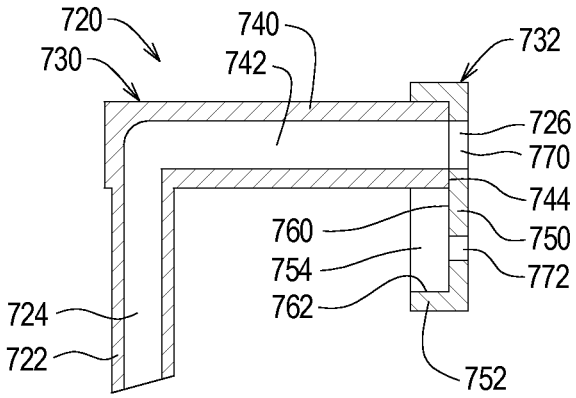
FIG. 8B is a side elevation section view of the seventh example actuator in a first configuration.
Figure 8C:
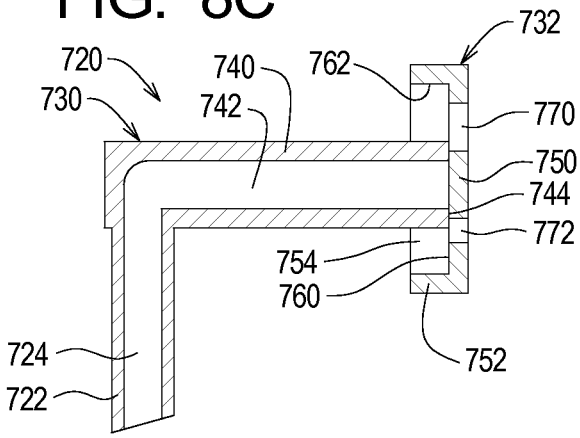
FIG. 8C is a side elevation section view of the seventh example actuator in a second configuration.
Figure 8D:
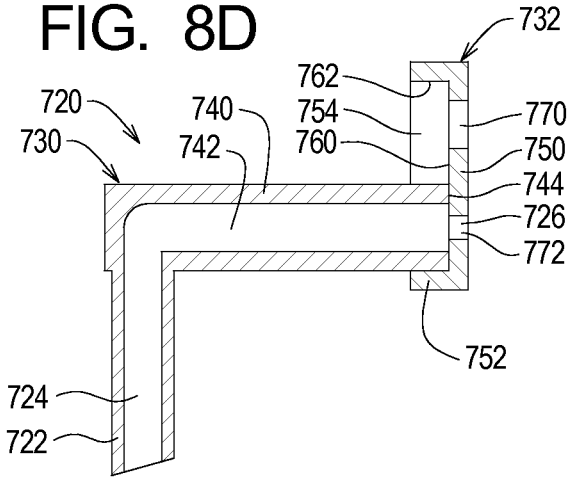
FIG. 8D is a side elevation section view of the seventh example actuator in a third configuration.

The adjustment member 732 is sized and dimensioned such that the perimeter wall surface 762 thereof frictionally engages the outer surface 744 of the base member 730 to detachably attach the adjustment member 732 to the base member 730 in either any of a continuum of positions between a first position as shown in FIGS. 8A and 8B and a second position as shown FIG. 8D. The outlet opening 726 is thus defined by the first adjustment opening 770 in the first configuration illustrated in FIG. 8B and by the second adjustment opening 772 in the second configuration illustrated in FIG. 8D. In both the first and second configurations shown in FIGS. 8B and 8D, the example outlet opening 726 is circular or oval in overall configuration.

Accordingly, by moving the adjustment member 732 relative to the base member 730, a cross-sectional area of the outlet opening 726 may be changed as can be seen by a comparison of FIGS. 8B and 8D. When the liquid portion 52 of the contained material 26 is forced through the actuator passageway 724, the characteristics of the spray 28 formed by the liquid portion 52 are defined by the outlet opening 726 formed as described above. The characteristics of the texture layer 62 formed by the spray 28 can thus be altered by changing the outlet opening 726 as defined above.

Figure 9A:
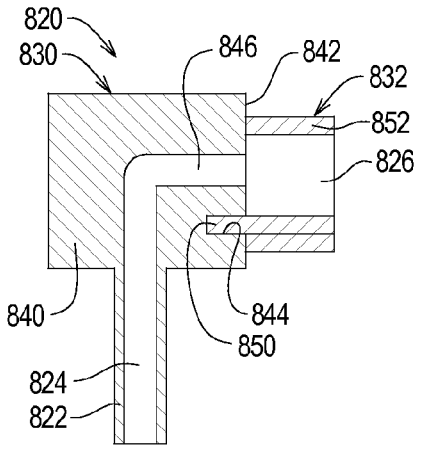
FIG. 9A is a side elevation section view of an eighth example actuator.
Figure 9B:
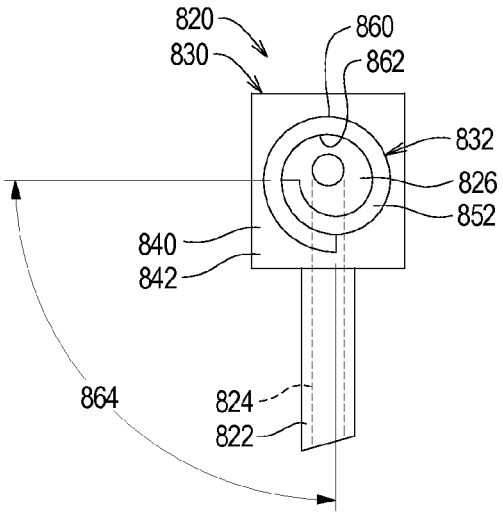
FIG. 9B is a front elevation view of the eighth example actuator in a first configuration.
Figure 9C:
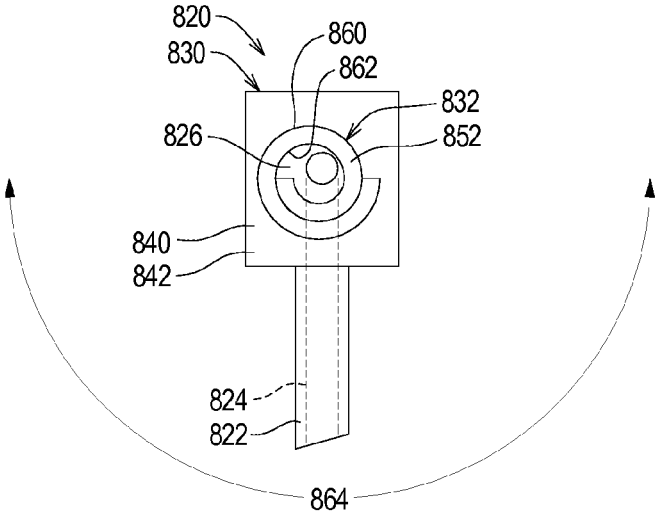
FIG. 9C is a front elevation view of the eighth example actuator in a second configuration.

FIGS. 9A-C illustrate an eighth example actuator 820 that may be used as the actuator 22 of the dispensing system 20. The actuator 820 comprises a stem portion 822 and defines an actuator passageway 824 and an outlet opening 826. The eighth example actuator 820 comprises a base member 830 and an adjustment member 832. The base member 830 comprises a main portion 840 defining a main surface 842 in which is formed a groove 844 and an inner opening 846. The adjustment member 832 defines an attachment portion 850 and an adjustment portion 852. The example adjustment portion 852 defines first and second surfaces 860 and 862 that define an overlapped portion 864.

The attachment portion 852 of the adjustment member 832 is sized and dimensioned to fit snugly within the groove 844 such that the adjustment portion is arranged to extend around the inner opening 846.

The outlet opening 826 is defined by the adjustment portion 852 of the adjustment member 832. In a first configuration as illustrated in FIG. 9B, the overlapped portion 864 extends along a smaller percentage of the entire 360° arc defined by the adjustment portion 852 than second configuration illustrated in FIG. 9C. By reducing the size or percentage of the overlapped portion 864, the outlet opening 826 is correspondingly made smaller. Increasing the size or percentage of the overlapped portion 864 effectively increases the size of the outlet opening 826.

Accordingly, by pinching or otherwise altering the shape of the adjustment member 832 such that the overlapped portion 864 is made larger or smaller, a cross-sectional area of the outlet opening 826 may be changed as can be seen by a comparison of FIGS. 9B and 9C. When the liquid portion 52 of the contained material 26 is forced through the actuator passageway 824 and the inner opening 846, the characteristics of the spray 28 formed by the liquid portion 52 are defined by the outlet opening 826 formed as described above. The characteristics of the texture layer 62 formed by the spray 28 can thus be altered by changing the outlet opening 826 as defined above.

What is claimed is:

1. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

an adjustment system arranged to vary a flow of stored material along the conduit passageway, where the adjustment system is arranged adjacent to the conduit outlet and comprises an actuator member that forms at least a portion of the conduit and defines at least a portion of the conduit passageway, a first adjustment member supported by the actuator member, a second adjustment member supported by the actuator member, and a first for movably connecting the first adjustment member to the actuator member; wherein the conduit outlet is defined by a first surface of the first adjustment member and a second surface of the second adjustment member; and at least one of the first and second adjustment members is movably supported by the actuator member such that moving the first and second adjustment members relative to each other alters a cross-sectional area of the conduit outlet.

2. An aerosol dispensing system as recited in claim 1, in which the stored material is texture material.

3. An aerosol dispensing system as recited in claim 1, further comprising a second pin, in which: the second pin movably connects the second adjustment member to the actuator member.

4. An aerosol dispensing system as recited in claim 1, in which the conduit outlet is further defined by third and fourth surfaces of the actuator member.

5. An aerosol dispensing system as recited in claim 1, in which at least one of the first and second surfaces is curved.

6. A method of dispensing stored material in a spray, comprising the steps of:

defining a chamber;

arranging the stored material and pressurized material within the chamber;

defining a conduit passageway having a conduit inlet and a conduit outlet;

arranging the conduit passageway such that the conduit inlet is arranged within the chamber and the conduit outlet is arranged outside of the chamber;

providing an adjustment system comprising an actuator member and first and second adjustment members;

arranging the actuator member to define at least a portion of the conduit passageway;

supporting the first and second adjustment members on the actuator member such that the conduit outlet is defined by a first surface of the first adjustment member and a second surface of the second adjustment member;

movably connecting the first adjustment member to the actuator member with a first pin; and moving the first adjustment member relative to the second adjustment member to alter a cross-sectional area of the conduit outlet and thereby vary a flow of stored material along the conduit passageway at the conduit outlet.

7. A method as recited in claim 6, in which the stored material is texture material.

8. A method as recited in claim 6, further comprising the steps of:

movably connecting the second adjustment member to the actuator member with a second pin; and moving the second adjustment member relative to the first adjustment member to alter a cross-sectional area of the conduit outlet.

9. A method as recited in claim 6, in which the conduit outlet is further defined by third and fourth surfaces of the actuator member.

10. A method as recited in claim 6, in which at least one of the first and second surfaces is curved.

11. An aerosol dispensing system for dispensing stored material in a spray, comprising:

a container defining a chamber containing the stored material and pressurized material;

a conduit defining a conduit passageway having a conduit inlet and a conduit outlet, where the conduit inlet is arranged within the chamber and the conduit outlet is arranged outside of the chamber;

an adjustment system arranged to vary a flow of stored material along the conduit passageway, where the adjustment system is arranged adjacent to the conduit outlet and comprises an actuator member that forms at least a portion of the conduit and defines at least a portion of the conduit passageway, a first adjustment member supported by the actuator member, and a second adjustment member supported by the actuator member; wherein the conduit outlet is defined by a first surface of the first adjustment member, a second surface of the second adjustment member, and third and fourth surfaces of the actuator member; and at least one of the first and second adjustment members is movably supported by the actuator member such that moving the first and second adjustment members relative to each other alters a cross-sectional area of the conduit outlet.

12. A method of dispensing stored material in a spray, comprising the steps of:

defining a chamber;

arranging the stored material and pressurized material within the chamber;

defining a conduit passageway having a conduit inlet and a conduit outlet;

arranging the conduit passageway such that the conduit inlet is arranged within the chamber and the conduit outlet is arranged outside of the chamber;

providing an adjustment system comprising an actuator member and first and second adjustment members;

arranging the actuator member to define at least a portion of the conduit passageway;

supporting the first and second adjustment members on the actuator member such that the conduit outlet is defined by a first surface of the first adjustment member, a second surface of the second adjustment member, and third and fourth surfaces of the actuator member;

moving the first and second adjustment members relative to each other to alter a cross-sectional area of the conduit outlet and thereby vary a flow of stored material along the conduit passageway at the conduit outlet.

* * * * *